United States Patent [19]

Miyahara

[11] 4,247,282

[45] Jan. 27, 1981

[54] LIQUID FUEL BURNER FOR BURNING LIQUID FUEL IN GASIFIED FORM

[75] Inventor: Kingo Miyahara, Tokyo, Japan

[73] Assignee: Dowa Co., Ltd., Tokyo, Japan

[21] Appl. No.: 41,818

[22] Filed: May 23, 1979

[30] Foreign Application Priority Data

May 26, 1978 [JP] Japan ..... 53/63065
Nov. 27, 1978 [JP] Japan ..... 53/146415

[51] Int. Cl.³ ..... F23D 11/04

[52] U.S. Cl. ..... 431/168; 239/214.11

[58] Field of Search ..... 431/168, 169; 239/214, 239/214.11, 214.17, 216, 217, 222, 222.11, 223, 224

[56] References Cited

U.S. PATENT DOCUMENTS

| | | | |
|---|---|---|---|
| 3,175,600 | 3/1965 | Powell | 431/168 X |
| 3,811,818 | 5/1974 | Miyahara | 431/168 |
| 3,844,705 | 10/1974 | Miyahara | 431/168 |
| 3,874,840 | 4/1975 | Miyahara | 431/168 |
| 3,982,880 | 9/1976 | Miyahara | 431/168 |
| 4,022,567 | 5/1977 | Miyahara | 239/214.11 X |

*Primary Examiner*—Robert S. Ward, Jr.
*Attorney, Agent, or Firm*—Norbert P. Holler

[57] ABSTRACT

A liquid fuel burner for burning liquid fuel in gasified form including a cylindrical main body having a flame blowoff nozzle and an inner bottom wall at opposite ends, a gas chamber, a combustion plate formed with a multitude of gasified fuel blowing openings, a fuel gasifying member, a fuel diffusing member, an air supply duct, a fuel supply line, an air ejection chamber and a rotary shaft supporting the fuel gasifying member and fuel diffusing member for rotation within the cylindrical main body. An annular wall is secured to and extends inwardly from the inner wall surface of the combustion plate in a position nearer to the inner bottom wall than the gasified fuel blowing openings, and a liquefied fuel flow preventing plate is secured at one end to the inner wall surface of the cylindrical main body in a position near to the flame blowoff nozzle and free at the other end to define a liquefied fuel sump between the inner wall surface of the main body and the liquefied fuel flow preventing plate. The fuel diffusing member is formed at its base with ventilating windows for permitting air to flow therethrough. The fuel supply line has a forward end disposed close to the outer circumferential surface of the fuel diffusing member and spaced apart therefrom by a multiple-dimension fuel supply gap.

4 Claims, 7 Drawing Figures

LIQUID FUEL BURNER FOR BURNING LIQUID FUEL IN GASIFIED FORM

BACKGROUND OF THE INVENTION

This invention relates to improvements in or relating to liquid fuel burners for burning liquid fuel in gasified form having a fuel gasifying member for scattering the liquid fuel in atomized particles and producing gasified fuel, a combustion cylinder mounting the fuel gasifying member for rotation to permit combustion of the gasified fuel to take place in a combustion chamber, and a gas chamber formed along the inner wall surface of the combustion cylinder to supply the gasified fuel therethrough from the fuel gasifying member to the combustion chamber for combustion therein.

The present invention is concerned particularly with the provision of improvements in a liquid fuel burner of the type described so that ignition and combustion of the liquid fuel in atomized particles can be expedited, heating of the fuel gasifying member more than is necessary by flames of combustion of the gasified fuel can be avoided, the noise produced by combustion of the gasified fuel can be minimized, incorporation of liquefied fuel in the blue flames of combustion of the gasified fuel can be prevented when the burner shifts from combustion of liquid fuel in atomized particles to combustion of gasified fuel, and the liquid fuel can be supplied in uniform quantities to the fuel gasifying member to permit stable combustion of the gasified fuel to be sustained in the combustion chamber of the combustion cylinder over a prolonged period of time.

In the liquid fuel burner of the type described hereinabove, the combustion cylinder having the gas chamber formed along its inner wall surface is formed of thin sheet metal, and the fuel gasifying member is mounted for rotation in the combustion cylinder so that the burner may automatically shift from combustion of liquid fuel in atomized particles to combustion of gasified fuel. In this burner, it is necessary that the combustion cylinder and fuel gasifying member be prevented from being damaged by the flames of combustion or from being heated more than is necessary. If no means is provided for preventing these troubles, the combustion cylinder would be damaged by the flames of combustion and become unfit for further service at early stages of its use, the liquid fuel supplied to the interior of the fuel gasifying member would not spread along its inner wall surface in a thin fuel layer of even thickness but would drip through the interior of the fuel gasifying member, with a result that it would be impossible to gasify the liquid fuel in uniform quantities. In addition, red flames would be formed among the blue flames of combustion of the gasified fuel.

In order to eliminate the aforesaid troubles, I have developed a liquid fuel burner for burning liquid fuel in gasified form which includes an air ejection chamber formed in the combustion cylinder for ejecting cold air therefrom and causing a stream of cold air to flow along the inner bottom wall of the combustion cylinder, to prevent the combustion cylinder from being damaged by the flames of combustion. This burner is disclosed in U.S. Pat. No. 3,874,840.

The liquid fuel burner for burning liquid fuel in gasified form described hereinabove has since been found to have some disadvantages. First, the stream of cold air ejected from the air ejection chamber and flowing along the inner bottom wall of the combustion cylinder impinges directly against the flames of combustion of gasified fuel vigorously blown through gasified fuel blowing openings into the combustion chamber within the combustion cylinder. Thus the stream of cold air is prevented from flowing forwardly and stagnates in vortical flow along the inner bottom wall of the combustion cylinder. As a result, it becomes impossible to produce gasified fuel stably in uniform quantities and to prevent the formation of red flames among the blue flames when the fuel gasifying member is strongly heated to excess by the flames of combustion of gasified fuel Secondly, since the combustion cylinder is not yet heated enough in the transition period in which the burner shifts from combustion of liquid fuel in atomized particles to combustion of gasified fuel following ignition of the liquid fuel in atomized particles, portions of the gasified fuel brought into contact with the inner wall surface of the combustion cylinder are liquefied, although small in quantity, and drip to the bottom of the combustion cylinder. The liquid fuel burns in red flames in the combustion chamber within the combustion cylinder or flows to outside therefrom.

Thirdly, a fuel diffusing member mounted in the interior of the fuel gasifying member is superheated by the heat of combustion at all times, and the liquid fuel supplied through a fuel supply line is repelled by the superheated fuel diffusing member to be changed into fuel drops. Thus it is impossible to obtain uniform diffusion of the liquid fuel and the fuel burns in an unsatisfactory condition, particularly when the fuel is of low quality, with residues of fuel being deposited on the inner wall surface of the fuel gasifying member.

Fourthly, difficulties are encountered in adjusting the quantity of liquid fuel supplied to the fuel gasifying member to obtain a satisfactory combustion condition in the liquid fuel burner for burning liquid fuel in gasified form in which the liquid fuel is supplied through the forward end of the fuel supply line disposed close to the outer circumferential surface of the fuel diffusing member so as to allow the liquid fuel to be diffused by the rotating fuel diffusing member into the interior of the fuel gasifying member which is also rotating. In this burner, the spacing between the forward end of the fuel supply line and the outer circumferential surface of the fuel diffusing member has an optimum value which may vary depending on the conditions including the viscosity of the liquid fuel, the pressure under which the liquid fuel is supplied, the angle of inclination of the outer circumferential surface of the fuel diffusing member and the number of revolutions of the fuel diffusing member. With the spacing being constant in dimension, the quantity of the liquid fuel supplied through the fuel supply line has very small upper and lower margins to be compatible with the dimension of the spacing. If the quantity were smaller than the lower margin, portions of the liquid fuel supplied would drip through the gap between the fuel diffusing member and the fuel supply line or leak along the outer circumferential surface of the fuel supply line. Even if it is desired to supply liquid fuel in a quantity larger than the upper margin, difficulties would be experienced in attaining the end because there is a limit to the opening of the fuel supply line relative to the outer circumferential surface of the fuel diffusing member. Thus the quantity of the liquid fuel that can be burned can only be controlled in a very narrow range.

SUMMARY OF THE INVENTION

The present invention obviates the aforementioned disadvantages of the prior art.

An object of the present invention is to provide a liquid fuel burner for burning liquid fuel in gasified form, wherein a combustion plate cooperating with the combustion cylinder to define the gas chamber is formed on its inner wall surface with an inwardly extending annular wall disposed in a position nearer to the inner bottom wall than the gasified fuel blowing openings formed in the combustion plate. The provision of the inwardly extending annular wall expedites ignition and combustion of the liquid fuel in atomized particles when the burner is actuated, and at the same time enables the cold air ejected along the inner bottom wall of the combustion cylinder to flow forwardly without any let or hindrance in an annular air layer along the outer wall surface of the fuel gasifying member, so that the annular air layer will serve as an air curtain for preventing the fuel gasifying member from being heated more than is necessary by the flames of combustion of the gasified fuel and for permitting the gasified fuel to be produced in uniform quantities in the fuel gasifying member. The gasified fuel produced in this way is ejected through a multitude of gasified fuel blowing openings into the combustion chamber with minimized noise.

Another object is to provide a liquid fuel burner for burning liquid fuel in gasified form, wherein a liquefied fuel flow preventing plate is attached to the combustion cylinder cooperating with the combustion plate to define the gas chamber, the liquefied fuel flow preventing plate being secured at one end thereof to the inner wall surface of the combustion cylinder in a position near to a flame blowoff nozzle of the combustion cylinder and free at the other end thereof to cooperate with the inner wall surface of the combustion cylinder to define a liquefied fuel sump within the gas chamber. By this arrangement, the fuel that might be liquefied in the transition period from the time of ignition to the time the combustion cylinder is heated to high temperature can be temporarily collected in the liquefied fuel sump to prevent its leak from the combustion cylinder, and the liquefied fuel thus collected can be gradually gasified as the temperature of the combustion cylinder rises, so that the gasified fuel will burn in blue flames and no red flames will be formed due to combustion of the liquefied fuel at initial stages of combustion following ignition.

A still another object is to provide a liquid fuel burner for burning liquid fuel in gasified form, wherein the fuel diffusing member is hollow and open at one end thereof and has ventilating windows formed at its base at which the fuel diffusing member is secured to the fuel gasifying member, the ventilating windows being disposed along the inner wall surface of the gasifying member. The fuel supply line has its forward end disposed close to the outer circumferential surface of the fuel gasifying member, so that air can be forcedly blown through the interior of the fuel diffusing member to prevent damage to the fuel diffusing member and its mounting portion by superheating at initial stages of use of the burner and also optimum diffusion of the liquid fuel by the fuel diffusing member can be achieved. An additional effect achieved by this arrangement is that the burner can be maintained in good combustion condition over a prolonged period of time without the deposition of residues of fuel occurring on the inner wall surface of the fuel gasifying member, even if the liquid fuel used is low in quality.

A further object is to provide a liquid fuel burner for burning liquid fuel in gasified form, wherein the forward end of the fuel supply line disposed close to the outer circumferential surface of the fuel diffusing member is spaced apart therefrom by a multiple-dimension fuel supply gap. The arrangement that the fuel supply gap between forward end of the fuel supply line and the outer circumferential surface of the fuel diffusing member is not constant but varies in going from one gap portion to another enables the fuel supply gap to accommodate changes in the quantity of the liquid fuel supplied through the fuel supply line over a wide range without requiring to vary the relative positions of the forward end of the fuel supply line and the outer circumferential surface of the fuel diffusing member, thereby making it possible to adjust the quantity of the burned fuel over a wide range.

Additional and other objects, features and advantages of the present invention will become apparent from the description set forth hereinafter when considered in conjunction with the accompanying drawings.

BRIEF DESCRIPTION OF THE DRAWINGS

In FIGS. 1 to 7, like reference characters designate similar or identical parts in all the drawings.

DESCRIPTION OF THE PREFERRED EMBODIMENT

Figure 1:
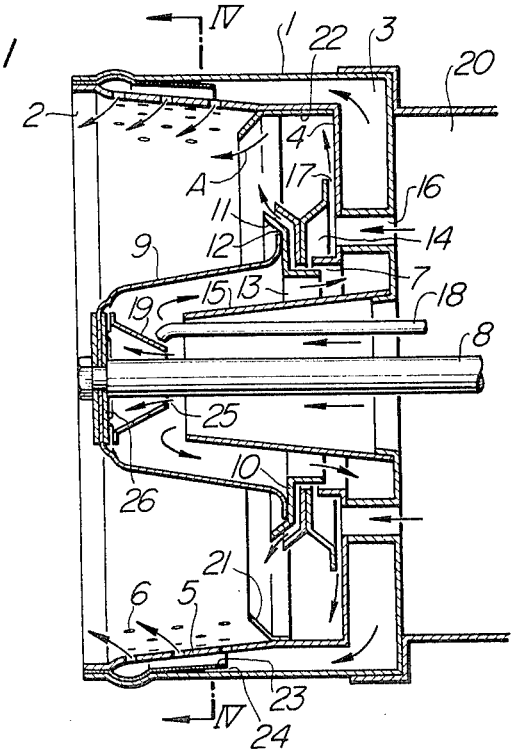
FIG. 1 is a vertical sectional front elevation of the liquid fuel burner for burning liquid fuel in gasified form comprising one embodiment of the invention, with certain parts being cut out.

A preferred embodiment of the present invention will now be described by referring to the accompanying drawings. In FIG. 1, a combustion cylinder 1 of thin sheet metal is formed at one end thereof with a flame blowoff nozzle 2 and has a combustion plate 5 secured at one end thereof to the inner wall surface of the combustion cylinder 1 and extending therealong to define a hollow gas chamber 3 having at its center an open end 7 defined by an inner bottom wall 4 extending inwardly from the combustion plate 5. The combustion plate 5 is formed with a multitude of gasified fuel blowing openings 6 of small diameter for smoothly ejecting gasified fuel therethrough into a combustion chamber within the combustion cylinder 1. Extending through the central portion of the combustion cylinder 1 is a rotary shaft 8 having secured to its forward end portion a cup-shaped fuel gasifying member 9 open at one end thereof and spaced apart from the central open end 7 of the gas chamber 3.

A gasified fuel-air mixing plate 10 is secured unitarily to the open end of the cup-shaped fuel gasifying member 9 and spaced apart therefrom by a fuel scattering gap 12. The gasified fuel-air mixing plate 10 is bent obliquely outwardly at its marginal portion to provide a fuel scattering surface 12 and formed at its central portion with gasified fuel-air mixture passages 13 for permitting gasified fuel to flow therethrough by forming a mixture with air forcedly fed and passing therethrough. The gasified fuel-air mixing plate 10 has the dual function of positively scattering the liquid fuel in atomized particles through the gap 12 into the combustion chamber, and preventing the leak of the gasified fuel produced in the fuel gasifying member 9 through a gap between the fuel gasifying member 9 and the central open end 7 of the gas chamber 3.

An air ejection chamber 14 is located in the vicinity of the central open end 7 of the gas chamber 3 and has formed at its periphery a cold air ejection gap 17 for ejecting cold air and causing same to flow along the inner bottom wall 4 of the combustion cylinder 1. The air ejection chamber 14 communicates, through ventilating openings 16, with an air supply chamber 20 which also communicates with the gas chamber 3 and the fuel gasifying member 9 through an air supply duct 15 extending at its forward end portion into the gas chamber 3 and fuel gasifying member 9 to open therein, so that a portion of the air forcedly fed to the air supply chamber 20 can be fed to the air ejection chamber 14. A fuel supply line 18 extends through the air supply duct 15 and has a forward end disposed close to the outer circumferential surface of a fuel diffusing member 19 of the frusto-conical shape formed of thin sheet metal.

Figure 2:
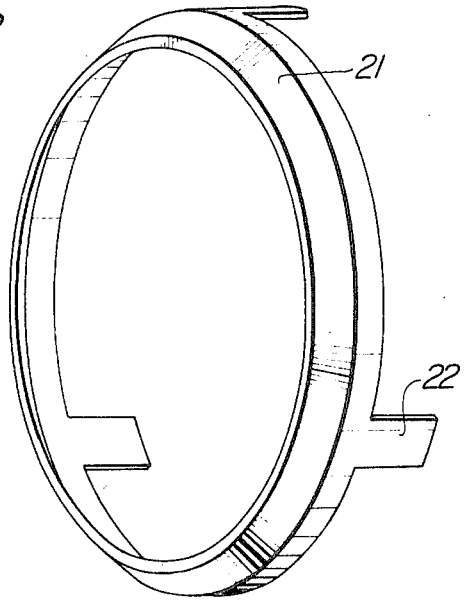
FIG. 2 is a perspective view of the inwardly extending annular wall.

An inwardly extending annular wall 21 extends inwardly from the inner wall surface of the combustion plate 5 in a position nearer to the inner bottom wall 4 of the combustion cylinder 1 than the multitude of gasified fuel blowing openings 6. In the embodiment shown and described herein, the inwardly extending annular wall 21 is formed, as shown in FIG. 2, with a plurality of mounting portions 22 depending therefrom for mounting the annular wall 21 at the inner wall surface of the combustion plate 5. It is to be understood that the annular wall 21 may be directly attached to the inner wall surface of the combustion plate 5 by eliminating the mounting portions 22. Alternatively, a portion of the combustion plate 5 may be bent and extended inwardly into the combustion chamber perpendicularly to the inner wall surface of the combustion plate 5, without using the annular wall 21.

Figure 4:
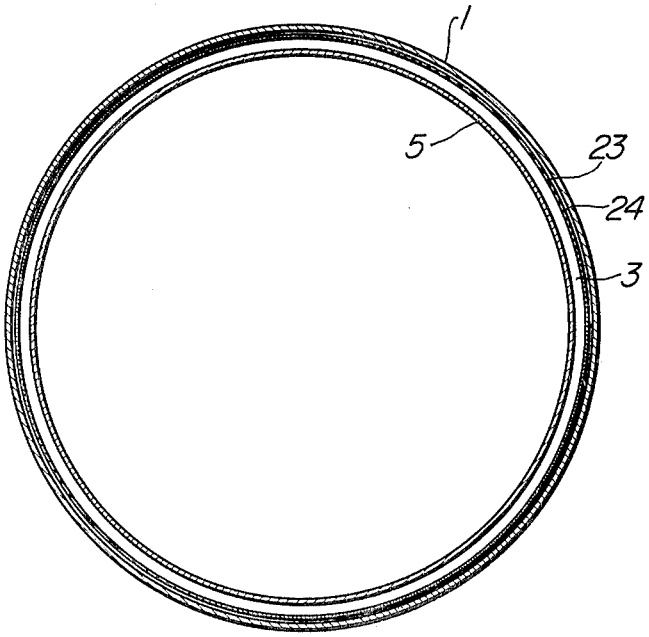
FIG. 4 is a sectional view taken along the line IV—IV in FIG. 1.

A liquefied fuel flow preventing plate 23 is joined as by welding at one end thereof near to the flame blowoff nozzle 2 to the inner wall surface of the combustion cylinder 1 and free at the other end thereof to cooperate with the combustion cylinder 1 to define a liquefied fuel sump 24 in the gas chamber 3. As shown in FIG. 4, the liquefied fuel flow preventing plate 23 extends through the entire circumference of the gas chamber 3.

Figure 5:
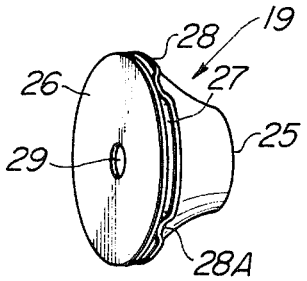
FIG. 5 is a perspective view of the fuel diffusing member.
Figure 6:
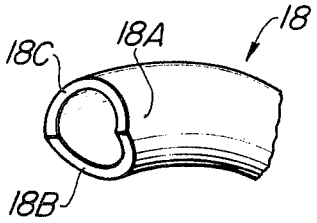
FIG. 6 is a perspective view showing a portion of the fuel supply line.
Figure 7:
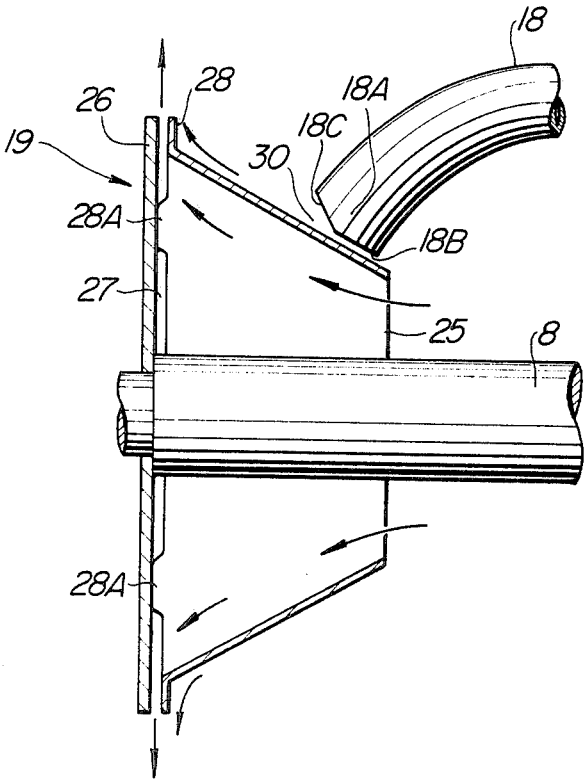
FIG. 7 is a view showing, on an enlarged scale, the essential portions of the burner shown in FIG. 1 including the fuel diffusing member and the fuel supply line.

As can be clearly seen in FIGS. 5 and 7, the fuel diffusing member 19, which is hollow and frustoconical in shape, opens at its minor diameter 25 and is closed at its major diameter end by a closure plate 26. The major diameter end of the fuel diffusing member 19 is formed along its circumference with a plurality of ventilating windows 27 disposed between the fuel diffusing member 19 and the closure plate 26, and a fuel scattering surface 28 extends outwardly from the major diameter end of the fuel diffusing member 19. The fuel scattering surface 28 has a plurality of projections 28A to which the closure plate 26 is joined as by spot welding, to form the ventilating windows 27. Instead of forming the ventilating windows 27, a suitable number of ventilating holes may be formed in the fuel scattering surface 28. The closure plate 26 is formed at its central portion with an opening 29 for securing the plate 26 over the rotary shaft 8.

The fuel supply line 18 extends from the air supply chamber 20 into the fuel gasifying member 9 in parallel with the rotary shaft 8 for rotating the fuel gasifying member 9. The fuel supply line 18 is bent at its forward end portion 18A toward the outer circumferential surface of the fuel diffusing member 19, so that its forward end will be disposed close to the outer circumferential surface of the fuel diffusing member 19. The forward end of the fuel supply line 18 is angled to provide a curved lower end portion 18B and a curved upper end portion 18C, the former being spaced apart from the outer circumferential surface of the fuel diffusing member 19 a smaller distance and the latter being spaced apart therefrom a larger distance. Thus the forward end of the fuel supply line 18 is spaced apart from the outer circumferential surface of the fuel diffusing member 19 by a multiple-dimension fuel supply gap 30 as shown in FIG. 7.

No ignition plugs have been shown and described in the embodiment of this invention. However, it is to be understood that ignition plugs are provided, of course, for igniting the liquid fuel in atomized particles when the burner is actuated.

In operation, rotation of the rotary shaft 8 causes the fuel gasifying member 9 and fuel diffusing member 19 to rotate in unison. Liquid fuel is supplied through the fuel supply line 18 to the fuel diffusing member 19, and at the same time air is forcedly fed to the interior of the fuel gasifying member 9 through the air supply duct 15. The liquid fuel supplied in this way to the fuel diffusing member 19 is scattered by its outer circumferential surface and transferred to the inner wall surface of the fuel gasifying member 9 where the liquid fuel further spreads in the form of a fuel film of uniform thickness until the liquid fuel in a film form is scattered in atomized particles through the fuel scattering gap 12 along the fuel scattering surface 11 toward the inwardly extending annular wall 21. A portion of the air forcedly fed through the air supply duct 15 to the interior of the fuel gasifying member 9 is blown through the fuel scattering gap 12 together with the atomized particles of liquid fuel to permit the scattered atomized particles of liquid fuel to be ignited by means of ignition plugs, not shown. The rest of the air flows through the gas chamber 3 and is ejected through the gasified fuel blowing openings 6 in the combustion plate 5 into the combustion chamber to expedite combustion of the liquid fuel in atomized particles. The flames of combustion of the liquid fuel in atomized particles strongly heat the fuel gasifying member 9, so that the liquid fuel spreading in the form of a fuel film along the inner wall surface of the fuel gasifying member 9 is quickly vaporized into gasified fuel which passes through the gasified fuel-air mixture passage 13 together with air and is supplied under pressure to the gas chamber 3. In the gas chamber 3, the gasified fuel and air are thoroughly mixed and the mixture is ejected through the multitude of gasified fuel blowing openings 6 of small diameter into the combustion chamber to burn therein.

Figure 3:
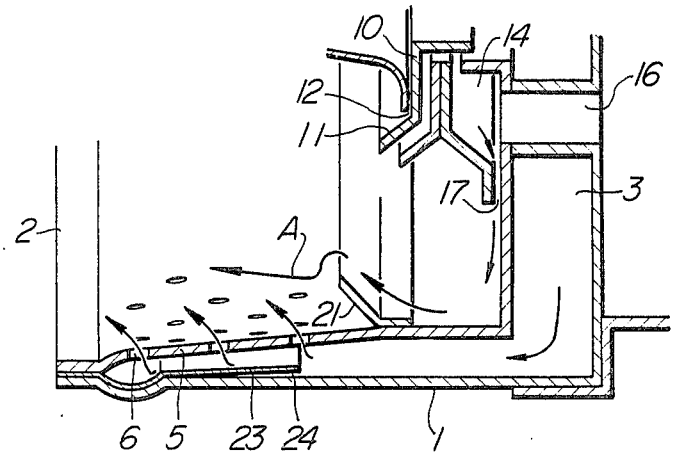
FIG. 3 is a sectional view, on an enlarged scale, of the essential portions of the burner shown in FIG. 1.

While the liquid fuel in atomized particles and the gasified fuel burn successively in the combustion chamber, cold air is fed from the air supply chamber 20 through ventilating openings 16 to the air ejection chamber 14, from which the cold air is ejected through the cold air ejection gap 17 and flows along the inner bottom wall 4 and the combustion plate 5 to cool same by forming an air curtain of uniform thickness therealong. The cold air forming the air certain tends to flow toward the outer wall surface of the fuel gasifying member 9 along the inwardly extending annular wall 21 located near to the inner bottom wall 4 than the gasified fuel blowing openings 6. Since the portion of the combustion chamber disposed along the underside of the wall 21 becomes negative in pressure, the cold air tending to flow toward the fuel gasifying member 9 is temporarily drawn into the negative pressure zone and changes its direction of flow along the fuel gasifying member 9 in the direction of an arrow A in FIG. 3. As a result, the flames of combustion of the mixture of gasified fuel and air ejected smoothly through the gasified fuel blowing openings 6 are covered at their upper ends by the air forming the air certain and flowing along the outer wall surface of the fuel gasifying member 9, and the flames are directed toward the flame blowoff nozzle 2 by the air curtain without directly heating the fuel gasifying member 9. Thus the flames of combustion of gasified fuel are arranged in a ring of flames directed toward the flame blowoff nozzle 2 by the air curtain, so that the noise of combustion can be greatly reduced.

In the burner shown and described hereinabove, the gasified fuel produced in the fuel gasifying member 9 is mixed with air and flows through the gasified fuel-air mixture passage 13 into the gas chamber 3 under pressure. However, when the burner is in the transition period in which the burner shifts from combustion of liquid fuel in atomized particles to combustion of gasified fuel, the inner wall surface of the combustion cylinder 1 would not be heated enough yet. If a portion of the gasified fuel-air mixture impinges against the inner wall surface of the combustion cylinder 1 not heated enough, the fuel might be liquefied and drip through the gas chamber 3 onto the lower portion of the combustion cylinder 1. In order to prevent this trouble, the liquefied fuel flow preventing plate 23 is provided to cooperate with the inner wall surface of the combustion cylinder 1 to provide the liquefied fuel sump 24. Thus any liquefied fuel can be temporarily collected in the liquefied fuel sump 24 and its leak to outside can be prevented. The liquefied fuel collected in the sump 24 is heated and vaporized into gasified fuel again as the temperature in the combustion cylinder 1 rises, so that no red flames of combustion of liquefied fuel will be formed among the blue flames of combustion of gasified fuel.

In the burner shown and described hereinabove, the air forcedly supplied from the air supply chamber 20 through the air supply duct 15 to the interior of the fuel diffusing member 19 through its open minor diameter end 25 is released from the member 19 through the ventilating windows 27 into the interior of the fuel gasifying member 9 to form an air curtain along the inner wall surface thereof. The air curtain has the effect of cooling the hollow fuel diffusing member 19 and its mounting portion of all times, to prevent superheating of the fuel diffusing member 19. Since superheating of the fuel diffusing member 19 is avoided, the liquid fuel supplied to its outer circumferential surface through the fuel supply line 18 is not repelled by the superheated member 19 to be formed into oil drops and stable scattering of the liquid fuel in atomized particles can be achieved at all times. Particularly when the liquid fuel is of low quality, carbon or other residues of fuel are not deposited on the fuel diffusing member 19, thereby ensuring that combustion takes place under satisfactory conditions at all times.

Moreover, in the burner shown and described hereinabove, the forward end of the fuel supply line 18 and the outer circumferential surface of the fuel diffusing member 19 are spaced apart from each other by the multiple-dimension fuel supply gap 30, because the curved lower end portion 18B is spaced apart from the outer circumferential surface of the fuel diffusing member 19 a smaller distance than the curved upper end portion 18C. Thus when the liquid fuel supplied through the fuel supply line 18 is small in quantity, the liquid fuel is supplied through the narrower gap portion of the multiple-dimensional fuel supply gap 30. As the quantity of the liquid fuel supplied increases, the flow gradually spreads from the narrower gap portion to a wider gap portion. In this way, the fuel supply gap between the forward end of the fuel supply line 18 and the outer circumferential surface of the fuel diffusing member 19 can accomodate any change in the quantity of the liquid fuel supplied through the fuel supply line 18, even if the quantity of supplied fuel is adjusted over a wide range. This makes it possible to control the quantity of fuel burned in the burner without causing dripping or leak of fuel or without having any trouble in the supply of fuel.

What is claimed is:

1. A liquid fuel burner for burning liquid fuel in gasified form, comprising:
   - a cylindrical main body;
   - a gas chamber formed by mounting a combustion plate and an inner bottom wall along the inner periphery of said cylindrical main body in spaced relationship, said gas chamber being formed with a central opening;
   - said combustion plate being formed therein with a multitude of gasified fuel blowing openings;
   - a cup-shaped fuel gasifying member open at one end thereof to communicate with said gas chamber;
   - an air duct extending into said fuel gasifying member and open therein;
   - a fuel diffusing member disposed at the substantially central portion of the inner surface of the closed end of said gasifying member;
   - a fuel supply line having a forward end disposed close to the outer circumferential surface of said fuel diffusing member; and
   - an air ejection chamber disposed in the vicinity of said central opening of said gas chamber for ejecting cold air along said inner bottom wall of said combustion cylinder;

wherein the improvement comprises an inwardly extending annular wall secured to the inner wall surface of said combustion plate in a position nearer to said inner bottom wall than said gasified fuel blowing openings.

2. A liquid fuel burner as set forth in claim 1, wherein the improvement comprises a liquefied fuel flow preventing plate secured at one end thereof to the inner wall surface of said cylindrical main body in a position close to a flame blowoff nozzle of said main body, the other end of said liquefied fuel flow preventing plate being free to define a liquefied fuel sump between the liquefied fuel preventing plate and the cylindrical main body.

3. A liquid fuel burner as set forth in claim 1, wherein the improvement resides in the arrangement whereby said fuel diffusing member, a hollow, frusto-conical body located in said fuel gasifying member and open at its end facing the open end of said air supply duct is formed at its base secured to said fuel gasifying member with ventilating windows disposed along the inner wall surface of the fuel gasifying member, said fuel supply line having a forward end disposed close to the outer circumferential surface of said fuel diffusing member.

4. A liquid fuel burner as set forth in claim 1, wherein the improvement resides in the arrangement whereby said fuel supply line has its forward end disposed close to the outer circumferential surface of said fuel diffusing member, and a multiple-dimension fuel supply gap is provided between the forward end of the fuel supply line and the outer circumferential surface of the fuel diffusing member.

* * * * *